US009333780B2

(12) United States Patent
Ito

(10) Patent No.: US 9,333,780 B2
(45) Date of Patent: May 10, 2016

(54) INK JET PRINTER

(71) Applicant: KABUSHIKI KAISHA TOSHIBA, Tokyo (JP)

(72) Inventor: Shinichi Ito, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 39 days.

(21) Appl. No.: 14/066,181

(22) Filed: Oct. 29, 2013

(65) Prior Publication Data

US 2014/0139589 A1 May 22, 2014

(30) Foreign Application Priority Data

Nov. 21, 2012 (JP) ..... 2012-255549

(51) Int. Cl.

| | |
|---|---|
| ***B41J 2/165*** | (2006.01) |
| ***B41J 29/17*** | (2006.01) |
| ***B41J 13/12*** | (2006.01) |
| ***B41J 3/01*** | (2006.01) |
| ***B41J 11/00*** | (2006.01) |
| ***B41J 29/377*** | (2006.01) |

(52) U.S. Cl.

CPC .. *B41J 29/17* (2013.01); *B41J 3/01* (2013.01); *B41J 11/002* (2013.01); *B41J 13/12* (2013.01); *B41J 29/377* (2013.01)

(58) Field of Classification Search

CPC ..... B41J 29/17; B41J 3/01; B41J 11/002; B41J 13/12; B41J 29/377

USPC ..... 347/34, 25, 36, 104

See application file for complete search history.

(56) References Cited

U.S. PATENT DOCUMENTS

| | | | | |
|---|---|---|---|---|
| 4,825,229 | A * | 4/1989 | Matsumoto | B41J 2/04 347/21 |
| 5,528,271 | A * | 6/1996 | Ebisawa | B41J 11/002 347/102 |
| 6,886,908 | B2 * | 5/2005 | Takahashi | B41J 11/06 347/34 |
| 2007/0229611 | A1 * | 10/2007 | Nagashima | B41J 2/175 347/84 |
| 2007/0268331 | A1 * | 11/2007 | Sakurai | B41J 2/1721 347/36 |
| 2010/0063622 | A1 * | 3/2010 | Fappiano | B07C 3/14 700/224 |
| 2010/0292833 | A1 * | 11/2010 | Gorp | B07C 5/3412 700/221 |

FOREIGN PATENT DOCUMENTS

JP 2005-028675 A 2/2005

OTHER PUBLICATIONS

Chinese Second Office Action dated Oct. 27, 2015, filed in Chinese Patent Application No. 201310526735.3, 17 pages (with English translation).

* cited by examiner

*Primary Examiner* — Henok Legesse

(74) *Attorney, Agent, or Firm* — Patterson & Sheridan, LLP

(57) ABSTRACT

An ink jet printer includes a transfer unit transferring a sheet of paper along a transfer path surface, a printer head ejecting ink towards the sheet of paper, and an air blowing unit blowing air towards ink ejected from the printer head. The sheet of paper may be a postal matter (e.g., letter, postcard, parcel) and the printer head may be used to print barcodes or the like on the sheet of paper for purposes of subsequent sorting and routing.

20 Claims, 6 Drawing Sheets

INK JET PRINTER

CROSS-REFERENCE TO RELATED APPLICATION

This application is based upon and claims the benefit of priority from Japanese Patent Application No. 2012-255549, filed Nov. 21, 2012, the entire contents of which are incorporated herein by reference.

FIELD

Embodiments described herein relate generally to an ink jet printer.

BACKGROUND

There is an ink jet printer type which prints bar codes (or the like) on sheets of paper such as postal matters (e.g., letters, postcards, parcels, or the like), with the bar codes providing destination information or the like. This type of ink jet printer detects conveyed postal matters by using a printing timing sensor, and ejects ink to the postal matters from a printer head so as to perform printing on the postal matters based on the detection.

According to the ink jet printer in the related art, however, there arises a problem in that the ink reaching the postal matters splashes against the postal matters and contaminates the surroundings with the splashing of the ink.

Moreover, the ink splashed against the postal matters adheres to the printing timing sensor, which can cause a problem of erroneous ejection of ink from the printer head.

DETAILED DESCRIPTION

In general, according to an embodiment, there is provided an inkjet printer capable of reducing contamination produced by ink ejected from a printer head onto sheets of paper.

According to one embodiment, there is provided an ink jet printer including a transfer unit configured to transfer a postal matter along a transfer path surface, a printer head configured to eject ink towards the postal matter to perform printing on the postal matter, and an air blowing unit configured to blow air towards the ink ejected from the printer head towards the postal matter. The ink ejected from the printer head may form secondary droplets after impacting (being splashed against) the sheet of paper, and the secondary droplets are blown off in a direction crossing the ejecting direction of the ink.

An example embodiment is hereinafter described with reference to the drawings.

Figure 1:
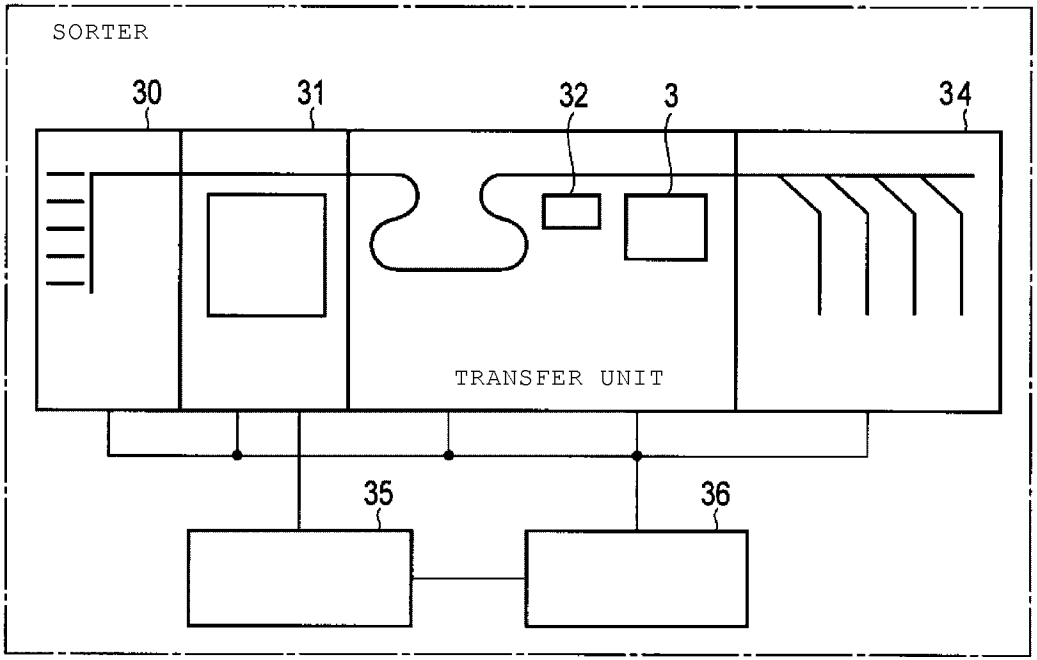
FIG. 1 illustrates the general structure of a postal matter sorter according to an embodiment.

FIG. 1 illustrates the general structure of a postal matter sorter according to one embodiment.

As used herein, a "postal matter" may be, for example a sheet of paper, a letter, postcard, envelop, or parcel that is to be processed by a postal matter sorter. The postal matter has numbers and information written, typed, or otherwise affixed thereon which may correspond to physical addresses, locations, post office boxes, or the like. The numbers and information may include a specific area number and a postal code number, such as a so-called "zip code." The numbers on the postal matter may also include postal codes such as designations related to special handling instructions (e.g., express mail, priority, or the like), routings, mail classifications, or the like.

Specifically, the postal matter may have provided thereon a bar code (address bar code) corresponding to the specific area number or a bar code given to specify the postal matter (ID bar code).

A sorter is a system which reads the specific area number or the address bar code that is on the postal matter, and identifies the specific area number based on the bar code to sort the postal matter based on predetermined sorting information such as the specific area number, or alternatively a code (specific area number) obtained from a video coding system (not depicted). The sorter may print a bar code that corresponds to the determined information (identification result) on each sorted postal matter.

The sorter includes a supply unit 30 which supplies the postal matters to the sub-sections of the sorter that read or identify the postal matters. The supply unit 30 supplies postal matters one by one for each post matter batch (lot). The postal matter batches may comprise postal matters from previous batches that were rejected by a sorter or another sub-system of the sorter.

The sorter includes a scanner unit 31 which reads an overall image (e.g., a photographic image) of each postal matter supplied from the supply unit 30, an ID bar code reading unit 32 which reads a bar code (address bar code) or a bar code (ID bar code), an inkjet printer 3 which can print a bar code corresponding to the specific area number or a bar code corresponding to a number on the postal matter, a sorting unit 34 which sorts the postal matter based on the information on the postal matter read by the bar code reading unit 32 or predetermined sorting information corresponding to a code obtained from the video coding system, and may allocate postal matters whose specific area numbers are not identified to a reject storage (not shown), an information processing unit 35 which can identify the specific area number based on the image received from the scanner unit 31, and a control unit 36 which can control the respective units discussed herein.

Figure 2:
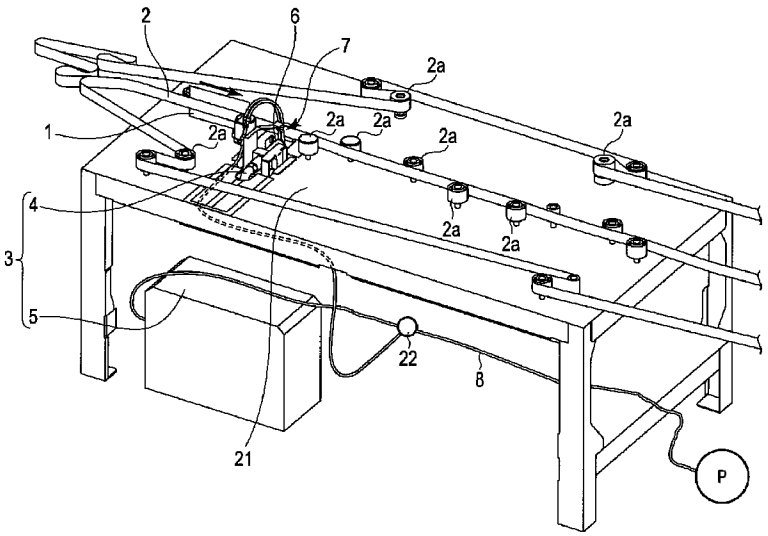
FIG. 2 is a perspective view of an inkjet printer shown in FIG. 1.

FIG. 2 illustrates the general structure of the ink jet printer 3. The ink jet printer 3 can be a "Universal 37 pc" series inkjet system manufactured by Videojet Technologies Inc., for example.

A postal matter (e.g., a sheet of paper) designated by a reference number 1 in FIG. 2 is nipped and transferred along a transfer path by using a transfer belt 2. The transfer belt 2 disposed on the upper surface side of a support member 21 extends thereon while engaging with a plurality of rollers 2*a* in such a manner as to freely travel. The transfer speed of the transfer belt 2 is 4 m/s, for example.

A printer head 4 is provided on the upper surface side of the support member 21 so as to face the reference number 1 on the postal matter to be transferred. Ink is ejected from the printer head 4 onto the postal matter 1 to print a destination bar code on the postal matter. The destination bar code corresponds to the information obtained by, for example, scanner 31 or bar code reader 32.

A printer main body 5 connected to the printer head 4 is disposed on the lower side of the support member 21. The ink jet printer 3 is comprised by the printer main body 5 and the printer head 4.

An air source P is connected to the printer main body 5 via an air supply tube 8. The ink jet printer 3 operates by receiving supply of designated air from the air source P, and this may be used to eject ink from the printer head 4.

The air supply tube 8 is branched at an intermediate portion via a branching unit 22, and a branched tube 8*a* of the air supply tube 8 is connected to a pair of air nozzles 10.

As noted above, the air source P is connected with the printer main body 5 via the tube 8, and further connected with an air blowing unit 7 via the branched tube 8*a*. According to this structure, air can be branched and supplied to each of the printer main body 5 and the air blowing unit 7 from a single air source P. Thus, the necessity of an additional air source dedicated for the air blowing unit 7 is eliminated, wherefore the structure of the system can be simplified.

Figure 3:
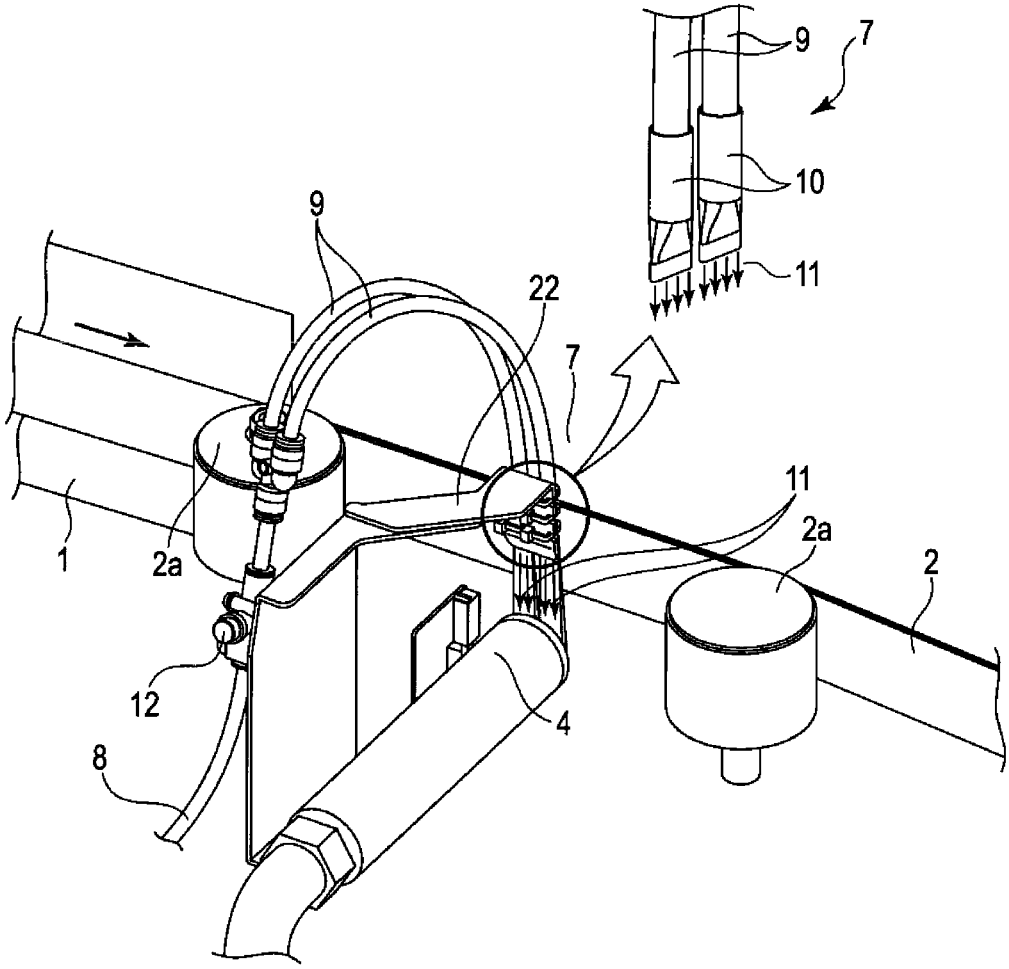
FIG. 3 depicts an enlarged area around a printer head depicted in FIG. 2.
Figure 4:
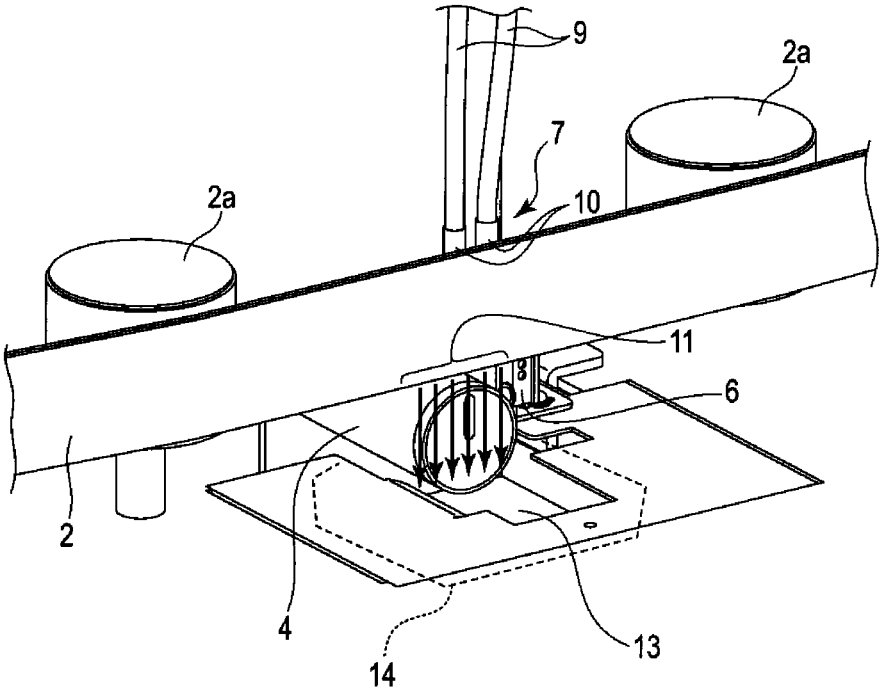
FIG. 4 depicts a view of the area around the printer head from a different angle.

FIGS. 3 and 4 depict the above-mentioned printer head 4 as viewed from different angles.

Here, the air blowing unit 7 as an air blowing means is provided on the upper side of the tip of the printer head 4. The air blowing unit 7 has a pair of the air nozzles 10. The pair of the air nozzles 10 are designed to blow air downward in this example, or more specifically, in a direction crossing (intersecting) the ink ejection direction from the printer head 4. The pair of the air nozzles 10 is disposed in parallel to the feed direction of the postal matter so as to widen the blow out range of air from the nozzles 10.

The pair of the air nozzles 10 is connected to the air source P via blowoff air tubes 9 and the branched tube 8*a*. A flow amount control valve 12 for controlling the flow amount of air is attached to the branched tube 8*a*.

An opening 13 is formed in the transfer path surface on the ink ejection side of the printer head 4. An ink receiver 14 for storing ink dropped by blowoff air 11 is provided on the lower side of the opening 13.

A printing timing sensor 6 is further disposed on the upstream side of the printer head 4 in the postal matter transfer direction such that printing can be initiated based on the detection of the postal matter by the printing timing sensor 6.

Figure 5A:
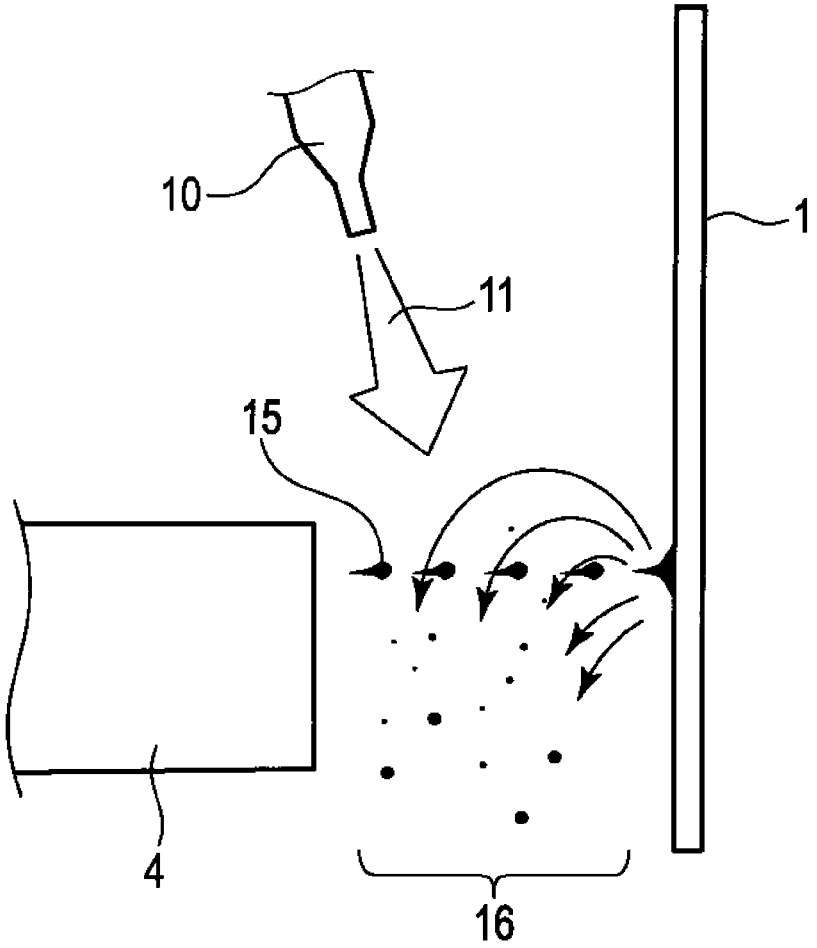
FIG. 5A depicts ink ejected from the printer head and splashed against a postal matter, where the ink is being forced downward by blowoff air.
Figure 5B:
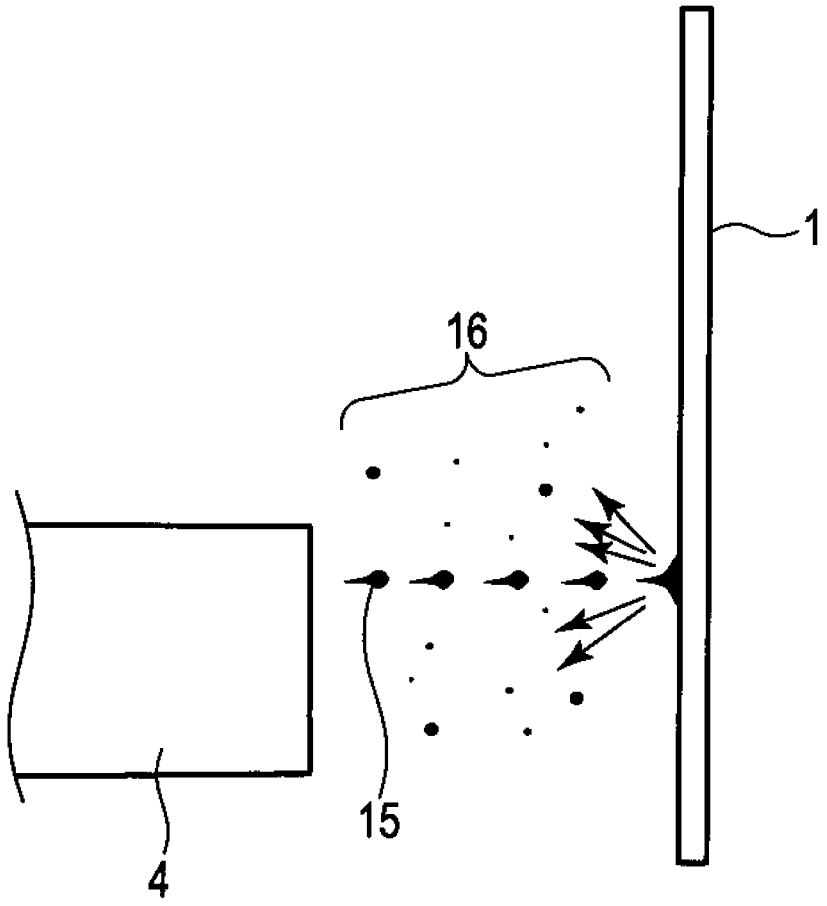
FIG. 5B illustrates a condition of ink ejected from the printer head and splashed against a postal matter.

For example, ink drops 15 are ejected from the printer head 4 in particular patterns as illustrated in FIG. 5B when the postal matter 1 is detected by the printing timing sensor 6. As a result, the ink drops 15 ejected at a predetermined speed adhere to the postal matter 1 to perform bar code printing thereon.

During this printing, the ink drops 15 ejected from the printer head 4 have a kinetic energy which is converted into fracture energy in the collision between the ink drops 15 and the postal matter 1. That is, the ink drops 15 may splatter when they impact the postal matter and generate smaller droplets of ink. Thus, as illustrated in FIG. 5B, a part of the ink after fracture separation splashes around and diffuses to the surroundings of the printing unit. This fracture separation (e.g., splattering) is generally undesirable as it results in ink accumulating in unwanted areas of the sorting system, the printer, or on the postal matters themselves.

The kinetic energy of splashed ink 16 is consumed by fracture separation process, wherefore the splashed ink 16 may float around the printing unit before depositing on unintended portions of the printing unit or subsequent postal matters being processed. For example, the splashed ink 16 floating therearound finally adheres to the surface of the printer head 4 or the transfer path surface, producing a possibility of dirt thereon.

According to this embodiment, however, air is blown downward from the air nozzles 10 of the air blowing unit 7 disposed on the upper side of the tip of the printer head 4 during printing as illustrated in FIG. 5A so as to force the splashed ink downward as indicated by arrows for rectification of the flow of the splashed ink. As a result, the dirt on the surface of the printer head 4 and the transfer path surface produced by the splashed ink will decrease.

During printing in this condition, it is conceivable that the ink drops 15 ejected from the printer head 4 are also affected by the blowoff air 11 blown from the air nozzles 10. However, the kinetic energy of the ink drops 15 ejected from the printer head 4 is generally much larger than the kinetic energy of the splashed ink 16, thus generally only the splashed ink 16 will be significantly affected by blow off air 11. Additionally, the flow amount of the blowoff air 11 can be adjusted to an appropriate volume to prevent altering the performance of ink drops 15.

The splashed ink forced downward by the air blown from the air nozzles 10 falls through the opening 13 formed in the transfer path surface, and accumulates in the ink receiver 14. The ink stored in the ink receiver 14 may be recovered.

Described hereinafter are the experimental results of a bar code printing performed 50,000 times on a postcard having a size of 148 mm×100 mm. The bar code printing was performed using an ink jet printer according to this embodiment and comparison results to the related art were obtained by using a device in the related art to perform bar code printing 50,000 times on a postcard having a size of 148 mm×100 mm. The results observed by the inventor are discussed below.

Table 1 shows that the splashed ink adhering to the surface of the printer head 4 and the transfer path surface is smaller relative to the related art when the flow amount of the blowoff air 11 is set to 10 L/min and is not noticeable when the flow amount of the blowoff air 11 is set to 15 L/min.

TABLE 1

| | Device of the related art | Embodiment with blowoff air at 10 L/min | Embodiment with blowoff air at 15 L/min |
|---|---|---|---|
| Observed amount of splashed ink adhering to printer head and transfer path surface | Large | Small | Minimal |

As a result of the level of improvement achieved herein, the printer head 4 and the transfer path surface do not have to be cleaned frequently, and so maintenance is facilitated considerably. More specifically, when the flow amount of the blowoff air is set to 15 L/min or larger, dirt caused by splashed ink can be further prevented.

In addition, the inventor has confirmed through experiments that there is no observable difference in quality of a bar code image printed with the device of the related art and a bar code image printed with the structure according to this embodiment (air blowout amount: 15 L/min).

According to this embodiment, therefore, diffusion of the splashed ink can be reduced at a low cost without deterioration of the quality of the printing image caused by the blowoff air 11 blown thereto.

Accordingly, such a printer can be realized which achieves considerable reduction of dirt on the printer and improvement of maintenance of the printer.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet printer, comprising:

a transfer unit configured to transfer a postal matter having address information printed thereon along a horizontally oriented transfer path surface in a vertical orientation, the transfer path surface having one or more planar sections;

a bar code reader for reading the address information on the postal matter;

a printer head configured to eject ink towards the postal matter in a direction that is orthogonal to the vertical orientation of the postal matter; and an air blowing unit configured to blow air towards the ink ejected from the printer head towards the postal matter in a direction parallel to the vertical orientation of the postal matter.

2. The ink jet printer of claim 1, wherein the air from the air blowing unit is blown in a direction that is orthogonal to the direction in which the ink is ejected by the printer head.

3. The ink jet printer according to claim 1, further comprising:

an opening in the transfer path surface that is proximate to a printing position at which the printer head ejects inks towards the postal matter.

4. The ink jet printer according to claim 3, further comprising:

an ink receiver below the opening, the ink receiver being configured to store ink blown by the blowing unit through the opening.

5. The ink jet printer according to claim 1, further comprising:

a single air supply source configured to supply the air to each of the printer head and the air blowing unit.

6. The ink jet printer according to claim 5, further comprising a branched supply line connected to the single air supply source.

7. The ink jet printer according to claim 1, wherein an air flow rate of air blown from the air blowing unit is in a range of 10 liters per minute to 15 liters per minute.

8. The ink jet printer according to claim 1, wherein the air blowing unit comprises a plurality of air nozzles.

9. The ink jet printer according to claim 8, wherein the plurality of air nozzles are disposed parallel to a transfer direction of the postal matter.

10. The ink jet printer according claim 1, wherein the printer head prints a bar code on the postal matter based on the address information on the postal matter.

11. The ink jet printer of claim 1, wherein the postal matter is one of a sheet of paper, a postcard, a letter, or a parcel.

12. A postal matter sorter, comprising:

a transfer unit configured to carry a postal matter having address information printed thereon in a first direction that is parallel to a surface of a support member to a printing position, wherein the postal matter is vertically oriented;

a printer head configured to eject ink toward the postal matter at the printing position in a direction that is orthogonal to the orientation of the postal matter for printing a bar code on the postal matter; and an air blowing unit configured to blow air towards ink ejected from the printer head in a direction parallel to the orientation of the postal matter.

13. The postal matter sorter of claim 12, further comprising:

an opening proximate the printing position through which ink droplets formed by ink ejected from the printer head is blown by the air blowing unit.

14. The postal matter sorter of claim 13, further comprising:

an ink receiver configured to collect ink droplets blown through the opening by the air blowing unit.

15. The postal matter sorter of claim 12, wherein a single air supply unit provides air for ejecting ink from the printer head and air to the air blowing unit.

16. The postal matter sorter of claim 12, wherein the printer head prints the bar code on the postal matter based on the address information on the postal matter.

17. A sorter, comprising:

a transfer unit configured to transfer a postal matter having address information printed thereon in a vertical orientation along a transfer path surface along a transfer direction that is parallel to a surface of a support member;

a printer head configured to eject ink in a direction that is orthogonal to the vertical orientation of the postal matter and towards the postal matter to print a bar code on the postal matter based on the address information on the postal matter;

an air blowing unit configured to blow air in a direction intersecting the direction of the ink towards the surface of the support member;

an opening in the transfer path surface, that is proximate to a printing position at which the printer head ejects ink towards the postal matter;

an ink receiver below the opening that is configured to store ink blown by the blowing unit through the opening.

18. The sorter of claim 17, wherein a single air supply source is used to provide air to the printer head for ejecting ink and the air blowing unit.

19. The sorter of claim 17, wherein the air blowing unit comprises a plurality of air nozzles.

20. The sorter of claim 17, wherein the postal matter is one of a sheet of paper, a postcard, a letter, or a parcel.

* * * * *